US007543426B1

(12) United States Patent
Phero

(10) Patent No.: US 7,543,426 B1
(45) Date of Patent: Jun. 9, 2009

(54) SKID WRAP ROLLER

(76) Inventor: Nelson Phero, 43 Beebetown Rd., Hammonton, NJ (US) 08037

( * ) Notice: Subject to any disclaimer, the term of this patent is extended or adjusted under 35 U.S.C. 154(b) by 100 days.

(21) Appl. No.: 09/693,096

(22) Filed: Oct. 20, 2000

Related U.S. Application Data

(60) Provisional application No. 60/160,628, filed on Oct. 20, 1999.

(51) Int. Cl.
*B65B 67/08* (2006.01)

(52) U.S. Cl. ..... 53/592; 53/389.4; 53/390; 53/588; 156/574; 156/577; 156/579; 242/588.2

(58) Field of Classification Search ..... 53/588, 53/389.2, 389.4, 390, 592, 556, 441; 242/588.2, 242/405.2, 405.3, 599.2, 588.6; 156/574, 156/577, 579
See application file for complete search history.

(56) References Cited

U.S. PATENT DOCUMENTS 1,226,928 A * 5/1917 Updike ..... 242/588.2
1,364,259 A * 1/1921 Eaton ..... 242/156
1,415,678 A * 5/1922 Moynihan ..... 242/118.4
4,014,477 A * 3/1977 Hyun ..... 242/395
4,102,513 A * 7/1978 Guard ..... 242/588.2
4,166,589 A * 9/1979 Hoover et al. ..... 242/599.2
4,179,081 A * 12/1979 Parry ..... 242/422.1
4,248,392 A * 2/1981 Parry ..... 242/422.1
4,360,172 A * 11/1982 Cope ..... 242/592
4,372,500 A * 2/1983 Saraisky ..... 242/613.5
4,477,037 A * 10/1984 Goldstein ..... 242/423.2
4,484,717 A * 11/1984 Goldstein ..... 242/422.1
4,522,348 A * 6/1985 Strout et al. ..... 242/422.1
4,535,951 A * 8/1985 Riemenschneider, III 242/423.2
4,714,211 A * 12/1987 Hwang ..... 242/423.1
5,520,360 A * 5/1996 Wensman ..... 248/354.5
5,673,542 A * 10/1997 Vartanian et al. ..... 53/556
5,749,539 A * 5/1998 Ratzel et al. ..... 242/598.3
5,788,608 A * 8/1998 Wilkinson ..... 482/51
5,868,334 A * 2/1999 Cedillo ..... 242/588.2
6,139,450 A * 10/2000 Rivers ..... 473/422
6,241,176 B1 * 6/2001 McEntee ..... 242/405.3
2008/0072543 A1 * 3/2008 Watson et al. ..... 53/441

* cited by examiner

*Primary Examiner*—Thanh K Truong
(74) *Attorney, Agent, or Firm*—Michael L. Greenberg, Esq.; Greenberg & Lieberman, LLC

(57) ABSTRACT

A tool used for wrapping boxes or shipments with plastic or other wrap in an ergonomic manner, as in warehouses or shipping departments. The tool is elongated and allows the user to rotate about the object to be wrapped. A tensioner makes it possible for the user to ensure that the wrapping is taught. A stopper allows the tool to come into contact with the ground.

8 Claims, 2 Drawing Sheets

SKID WRAP ROLLER

Priority is hereby claimed to Provisional Application No. 60/160,628 filed on Oct. 20, 1999 in the name of Nelson E. Phero for a Skid Wrap Roller.

FIELD OF THE INVENTION

The present invention is relative to an invention which facilitates the process of wrapping skids in such a manner so as to secure their contents without causing potential injury or harm to the laborer.

BACKGROUND OF THE INVENTION

The packing industry is renowned for the back injuries and muscle strains that often afflict its laborers and packers. Improvements geared toward the ergonomics of motion are often overlooked where manual laborers are concerned. The current invention is related to the field of skid wrapping which is integral to the freight or packing and shipping industries.

None of the relevant art, consisting of plastic wrap devices for wrapping "skids", have resolved the need for the operator to wrap skids from an awkward, bent over position, that generally puts strain on the spinal alignment and other muscles. Furthermore, smaller loads, which are too low to manipulate, also pose safety risks for the designated wrappers; although this type of load is generally placed on a forklift or electric lift to increase accessibility, the skid wrappers must often pass their arms and sometimes head beneath the skid in order to completely wrap the goods.

U.S. Pat. No. 4,102,513 issued to Twyman Guard on Sep. 14, 1977 describes a hand-held apparatus which is used to wrap plastic stretch film around an object. Unlike the present invention, Guard's device has a short handle which still requires the laborer to enter into awkward and possibly dangerous situations in order to surround the object with this film material.

U.S. Pat. No. 4,535,951 issued to Paul K. Riemenschneider, III on Aug. 20, 1985 describes an object useful in wrapping objects with a stretch film as well. This device, however, involves a mechanism in which a film roll with a tubular rigid core is clamped in between a pair of opposed core holders. A tension control assembly between the core and the core holders is responsible for adjustment of tension in the wrap during the wrapping process. Unlike the present invention, Riemenschneider's device does not provide an easier method to wrap the object which is beneficial to the health and safety of the laborer. Due to the design of the present invention, a user may wrap well above and below regular reach eliminating undue tension from bending and standing on toes to reach low and high objects respectively.

SUMMARY OF THE INVENTION

The present invention is a device that is safer and more convenient for the operator to use than conventional wrapping methods. More specifically, the present invention is a skid wrap roller device which enables the operator to wrap skids from a safe position minimizing the risk of strain or other injury to life and limb. The present invention includes a pole, with a stop on one side, inserted into the hollow center of a spool of plastic wrap. The present invention provides the user greater control of the wrapping process while operating the device from a standing position.

The general structure of the present invention is a 60" wooden or hollow metal pole (½" dia.) with a 6" diameter plastic base and rubber stopper at one end. A standard-sized plastic wrap spool can be slid onto the pole from the other (unstoppered) end. The extended pole functions in like manner to a broom handle, enabling the operator to grasp the tool and manipulate the direction of the wrap from the top end (analogous to the broom handle), while the plastic wrap unrolls from the spool at the bottom end (where the broom head would be), ultimately reaching the desired goal of completely encasing the skid.

The wrap circumvents all elements which are placed upon the skid in an organized and uncompromising fashion to the laborer's well-being. The skid wrapper will be at less risk for potential back and neck pain as well as spinal misalignment.

DETAILED DESCRIPTION OF THE PREFERRED EMBODIMENT

Figure 1:
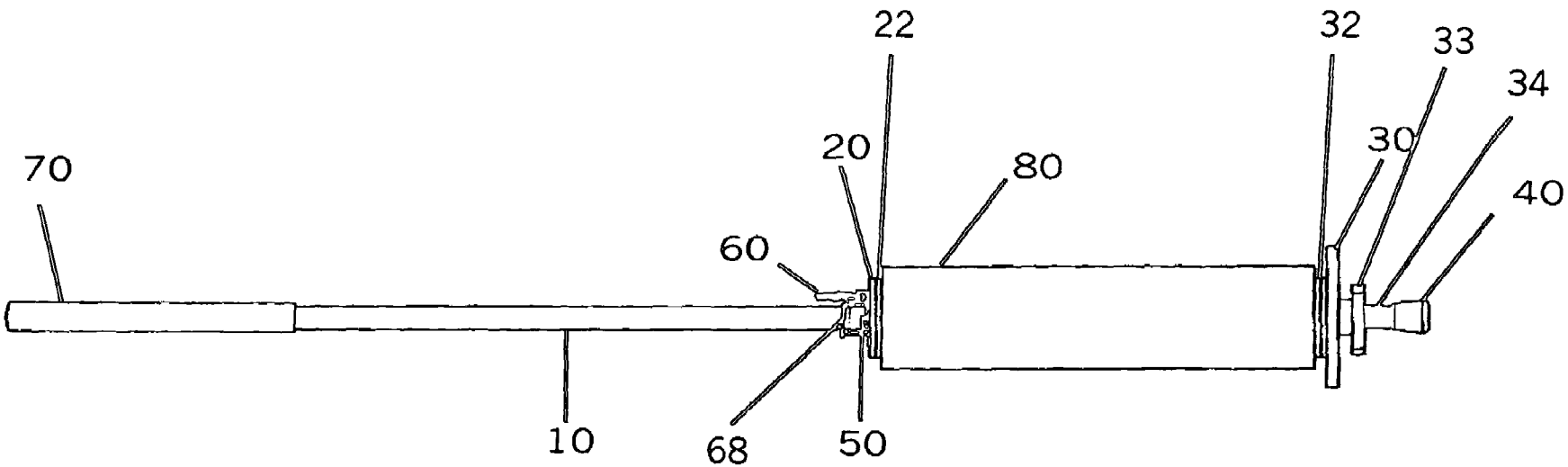
FIG. 1 is a side view of the present invention.

The present invention has a long wooden or metal pole (10), as shown FIG. 1, which is approximately 60" long; a foam grip (70) is disposed at the end of the pole (10). The long length of the pole (10) allows the laborer to hold the device and extend a spool (80) of wrap over an area to be covered without the laborer bending down and twisting the laborer's body in an awkward position. The length of the present invention eliminates squatting or climbing to properly wrap beds of items, and eliminates conventional ladder use in most wrapping due to height, because the spool (80) is disposed far along pole (10).

The pole (10) is inserted into spool (80) of wrapping material. Spool (80) is hollow. The diameter of 1 inch in the pole (10) provides for versatile use regarding different size spools (80) of wrapping material. Sleeve (68) is mounted atop pole (10) and has holes (50) along the diameter to act as attachments for a conventional cotter pin (not shown). The holes (50) are positioned along sleeve (68) for a 20", 18", 15", or 12" spool (80) of wrap, and corresponding holes (not shown) are similarly positioned along pole (10). It is contemplated that variously positioned holes (50) can be positioned along sleeve (68), and corresponding holes (not shown) can be similarly positioned along pole (10) depending on the length of a particular spool (80) chosen to be employed with the present invention. The hollow pole (10) serves as an axis about which the spool of wrap (80) can rotate. The smooth surface of the pole (10) allows for accelerated turning of the spool, and easier, expedited completion of the wrapping.

A stopper (40), preferably made of rubber, is continuous with a first end of the pole (10). The use of rubber for the stopper (40) allows easy turning access if the first end is placed on warehouse floors, loading docks or truck trailer beds while wrapping. The stopper (40) also protects low ceilings from marring as would happen with an unprotected end. The stopper (40) also acts as a safety measure to workers around the user if the present invention is extended in a somewhat horizontal manner from the objects being wrapped (not shown). Risk for injury is minimized by use of the stopper (40) if collision with other laborers should occur.

Tension from a circular plate (30) on the bottom side of the spool (80) and circular plug (20) on the top side of the spool (80) of wrap allow for secure and taut wrapping of the objects being wrapped (not shown). The circular plate (30) acts as a seat for an end of the spool (80) of wrap. The circular plug (20) also acts as a friction point to assist in the unraveling of the spool (80) of wrap. The plug (20) and plate (30) secure the spool (80) of wrap on the pole (10). The circular plug (20) is easily removed for spool (80) replenishment. The plate (30) and plug (20) are preferably fabricated of heavy plastic that is durable and easy to clean if necessary. In the preferred embodiment of the present invention, there are no bolts or screws necessary for attachment of plug (20) or plate (30). Plug (20) and plate (30) are separated from spool (80) via plug ring (22) and plate ring (32), respectively, which function like conventional washers.

Between plate (30) and stopper (40) are threads (34) which are part of pole (10). Threads (34) serve as a mounting point for tensioner (33), which is threaded on threads (34). Depending on the amount of resistance desired as the laborer turns spool (80), the tensioner (33) can be turned on threads (34) to apply pressure to plate (30) and cause spool (80) to turn more slowly, or tensioner (33) can be turned on threads (34) to remove pressure from plate (30) and cause spool (80) to turn more quickly.

Figure 2:
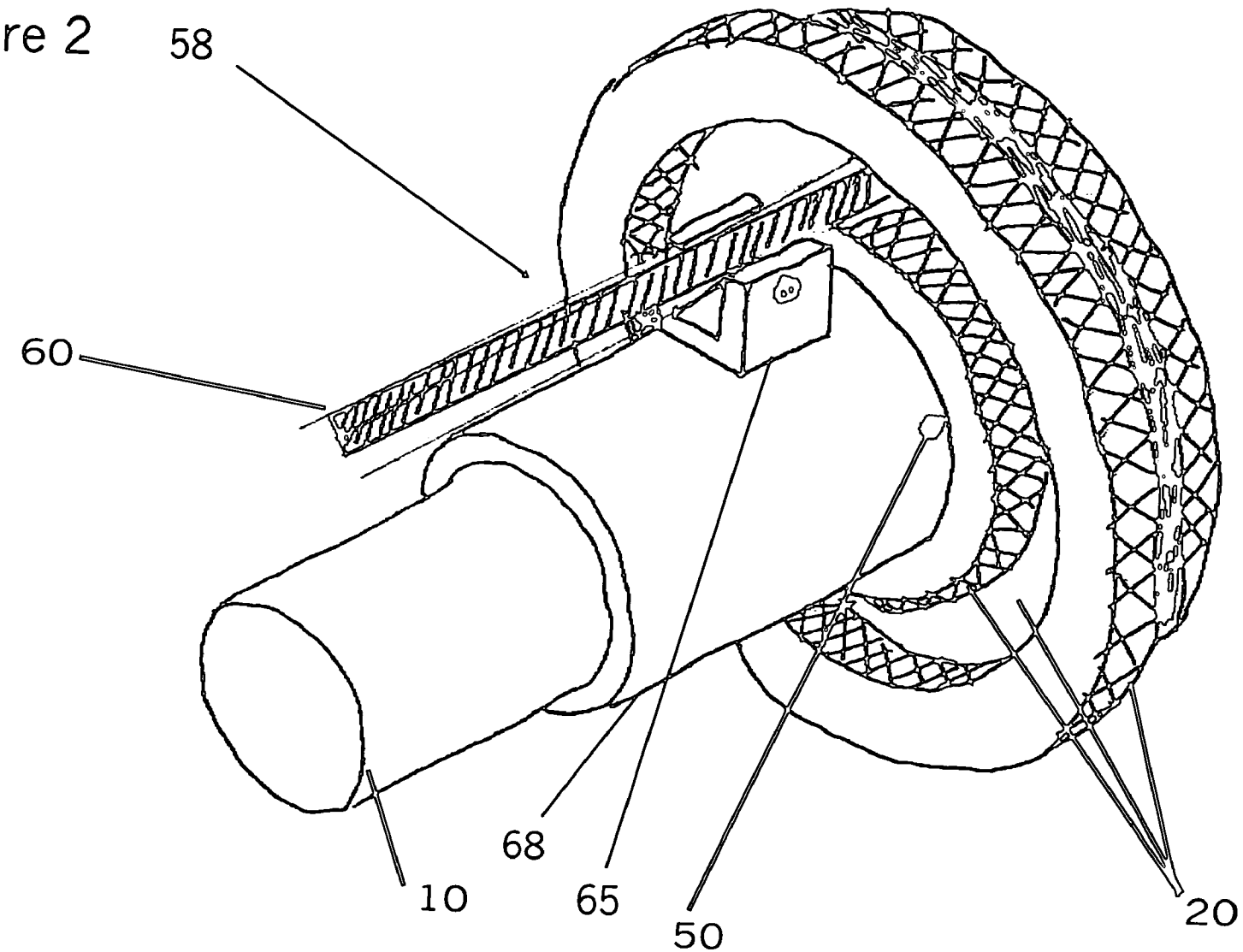
FIG. 2 is an exploded view of the brake assay.

Also included in the present invention is a brake assay (58) shown in FIG. 2 as an exploded view. The brake assay (58) works much like a bicycle brake, in that it has an arm (60) that can be depressed to stop the flow of the spool (80) of wrap around an object (not shown) being wrapped. The laborer completes the final wrapping motion around the object being wrapped and depresses the arm (60) so that it frictionally engages spool (80) to prevent spool (80) from moving. The laborer can easily cut the spool (80) of wrap from the object being wrapped with a tearing motion. The assay (58) enables the laborer to be efficient in the quantity of the wrap on the spool (80). Arm (60) pivots within channel (65), the second part of the assay (58), so that arm (60) that can be depressed to stop the turning of the spool (80). The third part of the assay (60) is the sleeve (68) which fits around pole (10). The sleeve (68) provides a mounting surface for the channel (65), and sleeve (68) rotates about pole (10).

The present invention can be utilized to assist in wraps above and below the laborers normal grasp of reach. The long length of the pole (10) allows for easy access to high beds of objects, while still having versatility in objects low to the ground or on the floor. The elimination of kneeling and squatting to wrap objects will greatly reduce discomfort and possible injury in the wrapping process.

Primarily, the present invention is intended to be used in the wrapping of items with a hand held non-motorized device, as in a warehouse for shipping or storing. It is to be understood that the present invention is not limited to the sole embodiment described above, but encompasses any and all embodiments within the scope of the following claims.

I claim:

1. A skid wrap roller for holding a spool of wrap comprising:

a straight linear pole, having a first end and a second end;

a sleeve, disposed on said pole toward said first end of said pole;

a plug, disposed on said pole toward said second end of said pole;

a plate, disposed on said pole toward said second end of said pole, said pole disposed through said plate so that said pole is on both sides of said plate;

a second set of holes in said sleeve arranged to receive a member perpendicular to said pole;

the spool on said straight linear pole;

a grip, said grip inline with the spool, disposed on said pole toward said first end;

a stopper, said stopper disposed on said pole toward said second end and said stopper being shorter than said grip; and an arm, a portion of a brake assembly disposed partially inside said plug, configured to pivot.

2. The skid wrap roller according to claim 1, wherein said stopper, said grip, and said spool are not symmetrical when in communication.

3. A skid wrap roller for holding a spool of wrap comprising:

a straight linear pole, having a first end and a second end;

a sleeve, disposed on said pole toward said first end of said pole;

a plug, disposed on said pole toward said second end of said pole;

a plate, disposed on said pole toward said second end of said pole, said pole disposed through said plate so that said pole is on both sides of said plate;

a second set of holes along said pole arranged to receive a member perpendicular to said pole;

the spool on said straight linear pole;

a grip, said grip inline with the spool, disposed on said pole toward said first end;

a stopper, said stopper disposed on said pole toward said second end and said stopper being shorter than said grip; and an arm, a portion of a brake assembly disposed partially inside said plug, configured to pivot.

4. The apparatus according to claim 3, wherein said second set of holes along said pole correspond to said first set of holes in said sleeve; and said grip is on said straight linear pole.

5. The skid wrap roller according to claim 3, wherein said stopper, said grip, and said spool are not symmetrical when in communication.

6. A skid wrap roller for holding a spool of wrap comprising:

a straight linear pole, having a first end and a second end;

a sleeve, disposed on said pole toward said first end of said pole;

a plug, disposed on said pole toward said second end of said pole;

a plate, disposed on said pole toward said second end of said pole, said pole disposed through said plate so that said pole is on both sides of said plate;

a brake assembly disposed toward said first end of said pole;

the spool on said straight linear pole;

a grip, said grip inline with the spool, disposed on said pole toward said first end;

a stopper, said stopper disposed on said pole toward said second end and said stopper being shorter than said grip; and an arm, a portion of said brake assembly disposed partially inside said plug, configured to pivot; and said grip and the spool on said straight linear pole.

7. The apparatus according to claim 6, wherein said brake assembly communicates with the spool.

8. The skid wrap roller according to claim 6, wherein said stopper, said grip, and said spool are not symmetrical when in communication.

* * * * *